US009961751B2

(12) United States Patent
Unoson et al.

(10) Patent No.: US 9,961,751 B2
(45) Date of Patent: May 1, 2018

(54) METHOD OF CONTROLLING LIGHT OUTPUT OF LUMINAIRE BY A CONTROL TERMINAL

(71) Applicant: Fagerhults Belysning AB, Habo (SE)

(72) Inventors: Daniel Unoson, Habo (SE); Mats Wernberg, Stockholm (SE)

(73) Assignee: FAGERHULTS BELYSNING AB, Habo (SE)

( * ) Notice: Subject to any disclaimer, the term of this patent is extended or adjusted under 35 U.S.C. 154(b) by 0 days. days.

(21) Appl. No.: 15/539,944

(22) PCT Filed: Dec. 29, 2014

(86) PCT No.: PCT/EP2014/079373
§ 371 (c)(1),
(2) Date: Jun. 26, 2017

(87) PCT Pub. No.: WO2016/107632
PCT Pub. Date: Jul. 7, 2016

(65) Prior Publication Data

US 2017/0347434 A1 Nov. 30, 2017

(51) Int. Cl.
*H05B 37/02* (2006.01)

(52) U.S. Cl.
CPC ..... *H05B 37/0272* (2013.01)

(58) Field of Classification Search
CPC .... H05B 37/02; H05B 37/0227; H05B 33/08; H05B 33/0806; H05B 33/0842; H05B 33/0845; H05B 32/0272
(Continued)

(56) References Cited

U.S. PATENT DOCUMENTS 9,392,657 B2 * 7/2016 Lee ..... H05B 33/0842

FOREIGN PATENT DOCUMENTS

| | | |
|---|---|---|
| WO | 2007/104137 A2 | 9/2007 |
| WO | 2008/001289 A2 | 1/2008 |
| WO | 2012/032452 A1 | 3/2012 |

OTHER PUBLICATIONS

International Search Report and Written Opinion for International Application No. PCT/EP2014/079373, dated Sep. 29, 2015 (9 pages).

* cited by examiner

*Primary Examiner* — Jimmy Vu
(74) *Attorney, Agent, or Firm* — Kagan Binder, PLLC

(57) ABSTRACT

Method of controlling light output (44) of a luminaire (40) using a control terminal (30), wherein the luminaire comprises at least one light source (46) and a control unit (42), the control terminal comprising a display. The method comprises the steps of sending, from the control terminal to the control unit, an interrogation (T1) of light output adjustment ability of the luminaire, receiving, from the control unit to the control terminal, information (T2) of light output adjustment ability of the luminaire wherein the information comprises at least three input values representing coordinates in a chromaticity diagram and defining an adjustment area in the chromaticity diagram, evaluating the information of light output adjustment ability from the luminaire, and displaying, on the display (32) of the control terminal, a light output control (50, 60), for adjustment of the color or color temperature of the luminaire, the light output control being single-variable or multi-variable depending on the evaluation of the information of light output adjustment ability received from the control unit.

16 Claims, 7 Drawing Sheets

(58) Field of Classification Search
USPC .... 315/129–134, 185 R, 150–152, 291, 297,
315/307, 308, 312
See application file for complete search history.

METHOD OF CONTROLLING LIGHT OUTPUT OF LUMINAIRE BY A CONTROL TERMINAL

CROSS-REFERENCE TO RELATED APPLICATIONS

This application claims priority to International Application No. PCT/EP2014/079373, filed Dec. 29, 2014, and titled "METHOD OF CONTROLLING LIGHT OUTPUT OF LUMINAIRE BY A CONTROL TERMINAL", which is incorporated herein by reference in its entirety.

TECHNICAL FIELD

The present disclosure relates to a method of controlling light output of a luminaire, a control terminal for such controlling, a luminaire to be controlled and a system thereof.

BACKGROUND

In modern lighting systems, comprising one or several luminaries, it may be possible to control the luminaire via for instance a mobile phone and an application installed therein. Such systems may use the Digital Addressable Lighting Interface (DALI) standard for communication to control the light output. The control may include to switch the luminaire on or off, or to control color or color temperature of the light output.

However, different luminaries may have different properties to be controlled when it comes to color or color temperature. The DALI does not specify a common interface for each luminaire using the standard. A mobile phone used for controlling luminaries may thereby need different applications for different luminaire types, or be limited to control only a certain luminaire type.

Consequently, there is a need for a solution wherein a mobile phone or similar may be used for controlling luminaries having different properties to be controlled.

SUMMARY

It is an object of the present invention to provide an improved solution that alleviates the mentioned drawbacks with present devices. Furthermore, it is an object to provide control of light output of a luminaire which adjusts to the adjustment ability of the luminaire.

According to a first aspect of the invention, a method of controlling light output of a luminaire using a control terminal is provided, wherein the luminaire comprises at least one light source and a control unit, the control terminal comprising a display. The method comprises the steps of sending, from the control terminal to the control unit, an interrogation of light output adjustment ability of the luminaire, receiving, from the control unit to the control terminal, information of light output adjustment ability of the luminaire wherein the information comprises at least three input values representing coordinates in a chromaticity diagram defining an adjustment area, evaluating the information of light output adjustment ability from the luminaire, and displaying, on the display of the control terminal, a light output control, for adjustment of the color or color temperature of the luminaire, the light output control being single-variable or multi-variable depending on the evaluation of the information of light output adjustment ability received from the control unit.

The control of the light output from the luminaire may need different configurations depending on the adjustment ability of the luminaire. A luminaire comprising light sources that alone or together may provide light output of different colors, the control of the light output may need to enable control of full RGB color output. Such control may enable a multi-variable control. Such multi-variable control may be provided as a chromaticity diagram in which a desired color may be selected.

Further, a luminaire may be able to provide light output of different color temperature, for instance white light of different color temperature along the black body locus in a chromaticity diagram. For control of such luminaire, a single variable control may be provided for selecting a color temperature along a scale. The single-variable control may be provided as a slide control, a turning control or the like.

By using the method according to an embodiment of the present invention, the light output of the luminaire may more easily be controlled from a control terminal. The control may be facilitated by the selection of single-variable or multi-variable control. The actual light output adjustment ability of the luminaire may be reflected in the displayed control on the control terminal, thereby providing a correct adjustment control for a user.

A single-variable control may be a control which is capable of controlling or adjusting a single parameter. It may be described as a one-dimensional control. Such single parameter may be color temperature along the black body locus.

A multi-variable control may be a control which is capable of controlling or adjusting more than one parameter simultaneously. If the multi-variable control is capable of controlling two parameters, it may be described as a two-dimensional control. Such two parameters may be positions along x and y axes in a chromaticity (CIE) diagram. With such multi-variable/two-dimensional control, a color within the chromaticity diagram may be selected. Hence the light output color of the luminaire may be selected among colors in the chromaticity diagram. Alternatively, the multi-variable control may provide control of three parameters corresponding to adjustment of RGB color settings.

The information of light output adjustment ability from the luminaire may comprise at least three coordinates in a chromaticity diagram defining an adjustment area, and the step of evaluating the information may comprise a step of evaluating the adjustment area in the chromaticity diagram.

The at least three coordinates may define boundaries within which possible colors or color temperatures of the light output of the luminaire are provided. The light output control may thereby be selected to provide adjustment control within the possible color or color temperature boundaries of the light output.

In one embodiment, the step of evaluating the information may comprise a step of comparing the adjustment area in the chromaticity diagram with a predetermined area in the chromaticity diagram.

Depending on the adjustment area's relation to the predetermined area in the chromaticity diagram, the control may be selected differently. The predetermined area may be set as a threshold value for control selection. By basing the comparison and selection on coordinates in the chromaticity diagram, a close connection to the actual light output ability of the luminaire may be provided. Further, the setting of the boundaries of the predetermined area may be facilitated.

In another embodiment, the step of comparing the adjustment area with the predetermined area may comprise a step of determining if the adjustment area extends outside the predetermined area.

The predetermined area may be used as a threshold for the light output adjustment ability of the luminaire. The threshold may be used as a two-dimensional threshold, forming the predetermined area. The conditions of the threshold may then be formed as whether the adjustment area extends outside the predetermined area or if it extends outside the predetermined area. I.e. if any of the coordinates defining the adjustment area is located outside the predetermined area, a first condition is fulfilled in the comparison step, and if all of the coordinates is located within the predetermined area, a second condition is fulfilled in the comparison step. In one embodiment, a further determination may be made if said first condition is fulfilled, wherein for each coordinate located outside the predetermined area, the coordinate's distance to the closest boundary of the predetermined area is considered. If said distance, for each coordinate located outside the predetermined area, is small enough, i.e. is below a distance threshold, said second condition may anyway be considered fulfilled instead of said first condition.

In one embodiment, the step of displaying a light output control on the display of the control terminal may comprise a step of displaying a multi-variable control if the adjustment area is determined to extend outside the predetermined area, and a step of displaying a single-variable control if the adjustment area is determined to be within the predetermined area.

When a first condition is fulfilled from the comparison step, i.e. that any of the coordinates defining the adjustment area is located outside the predetermined area in the chromaticity diagram, it may be determined that the luminaire is able to provide light output of different colors. Such light output may be defined as colors selected within the adjustment area in the chromaticity diagram. To enable a user to control the light output of the luminaire having such adjustment abilities, a multi-variable control may be needed to enable all possible light output colors (or color temperatures) to be selected. Further, if a second condition is fulfilled, i.e. that all coordinates are located within the predetermined area, it may be determined that the luminaire is able to provide light output of colors or color temperatures located along a line in the chromaticity diagram. A single-variable control may then be selected to provide easy control of the light output. By selecting the type of control depending on the extension of the adjustment area relative to the predetermined area, it may be assured that a user is provided with the most suitable control for the present luminaire's light output adjustment ability.

In one embodiment may more than one predetermined area be provided to enable selection of single-variable control is the coordinates of adjustment area all are located within one of the predetermined areas. In the chromaticity diagram, there may be more than one area which may be defined as extending along a line, and for which light output of colors/color temperatures within may be suitable to control with a single-variable control. To enable luminaries having light output adjustment abilities suitable for single-variable control, the method may enable different areas of the chromaticity diagram defining such predetermined areas.

In a further embodiment, the predetermined area may be focused or arranged around the black body locus.

If the predetermined area is defined around the block body locus, a single-variable control may be selected when the adjustment area extends along the whole or a part of the black body locus, for adjustment of the color temperature of the light output. If more than one predetermined area is provided, one of the predetermined areas may be defined around the black body locus. By being focused it may be meant that the predetermined area surrounds the whole or a part of the black body locus line in the chromaticity diagram. It may further be meant the predetermined area is an area having a lower perimeter following the extension of the whole or a part of the black body locus at a first side and with a distance thereto, and having an upper perimeter following the extension of the whole or a part of the black body locus at a second, opposite, side and with a distance thereto. The distances to the lower and the upper perimeters may be substantially the same. The lower and the upper perimeter may be connected by end perimeters to form the predetermined area.

In one embodiment may the predetermined area represent substantially white light of different temperature in the chromaticity diagram.

In one embodiment, the control unit may comprise a DALI driver configured to receive the interrogation from the control terminal and to provide the information of light output adjustment ability sent to the control terminal.

The DALI driver may be a device type 8 compatible DALI driver. The DALI driver may be suitable for controlling the light output of the luminaire. The control unit comprising the DALI driver may provide the information of the light output adjustment ability as a response to the interrogation from the control terminal. Further, when a suitable control is displayed on the control terminal and provided to a user, the user may control the light output of the luminaire via the displayed control on the control terminal and the control unit comprising the DALI driver. When the user controls the light output via the displayed control, control signals may be sent from the control terminal to the control unit and DALI driver in the luminaire. The light output may be adjusted by the DALI driver as a response to the received control signals.

According to a second aspect of the invention, a computer program product is provided which is configured to, when executed in a control terminal comprising a display, perform the method according to the above.

The same computer program product may be used for the control of different luminaries having different color or color temperature adjustment abilities. A user does thereby not need to know anything about the adjustment ability of a certain luminaire to be able to control its light output.

According to a third aspect of the invention, a control terminal is provided comprising a display and the computer program product according to the above.

The control terminal may comprise a terminal control unit configured to execute the computer program product. The control unit may further comprise a storage element for storing the computer program product. The terminal control unit may comprise a processor for executing the computer program product. The terminal control unit may further comprise a display control element configured to control what is displayed on the display. The terminal control unit may further be configured to register user input via the display being a touch display, or via buttons on the control terminal. The terminal control unit may further comprise a communication unit configured for wireless communication with the control unit of the luminaire.

The luminaries to be controlled may be used in for instance homes and office spaces and be controllable from a control terminal. Different luminaries in an office space may be adjustable with regard to color or color temperature in different ways. A user accessing different areas in the office may then control different luminaries using the same control terminal, and also the same computer program product in the control terminal, even though the adjustment abilities of the luminaries may be different.

In one embodiment, the control terminal may be a mobile device, such as a mobile phone, a smart phone or a tablet computer.

The computer program product in the control terminal may be a software application in a mobile phone, a smart phone or a tablet computer. By providing the light output control in a mobile device, it may be easy accessible for a user. Further, a mobile device may be suitable for providing a light output control depending on the light output adjustment ability of the luminaire. The mobile device may be configured to communicate with a luminaire via a wireless network (Wi-Fi) or Bluetooth connection.

According to a fourth aspect of the invention, a luminaire is provided comprising at least one light source and a control unit. The control unit is configured to receive, from a control terminal, an interrogation of light output adjustment ability of the luminaire, send, as a response to the interrogation, information to the control terminal of the light output adjustment ability of the luminaire, wherein the information of light output adjustment ability is provided by at least three input values representing coordinates in a chromaticity diagram and defining an adjustment area in the chromaticity diagram within which the light output of the luminaire is adjustable.

Such luminaire may be used in for instance homes and office spaces to be controllable from a control terminal, such as a mobile device. Different luminaries in an office space may be adjustable with regard to color or color temperature in different ways. A user accessing different areas in the office may then control different luminaries using the same control terminal, and also the same computer program product in the control terminal, even though the adjustment abilities of the luminaries may be different. The information sent from the control unit may be used by the control terminal to be evaluated to determine a suitable light output control to be displayed on the control terminal. A user may use the display to control the light output of the luminaire. When the user operates the displayed control, the control terminal may be configured to send control signals to the control unit of the luminaire corresponding to said control operation. The control unit may be configured to receive such control signals and to adjust the light output of the luminaire accordingly.

The coordinates in the chromaticity diagram may be used to define the adjustment ability of the luminaire in a way that may easily be evaluated. The adjustment ability may thereby be defined in numbers that may be used for an evaluation or calculation to determine how to control the light output.

In a further embodiment, the control unit may comprise a DALI driver.

The DALI driver may be a device type 8 compatible DALI driver. The DALI driver may be suitable for controlling the light output of the luminaire. The control unit comprising the DALI driver may provide the information of the light output adjustment ability as a response to the interrogation from the control terminal. Further, when a suitable control is displayed on the control terminal and provided to a user, the user may control the light output of the luminaire via the displayed control on the control terminal and the control unit comprising the DALI driver. When the user controls the light output via the displayed control, control signals may be sent from the control terminal to the control unit and DALI driver in the luminaire. The light output may be adjusted by the DALI driver as a response to the received control signals.

According to a fifth aspect of the invention, a luminaire system is provided comprising a control terminal according to the above, and a luminaire according to the above.

BRIEF DESCRIPTION OF THE DRAWINGS

The invention will in the following be described in more detail with reference to the enclosed drawings, wherein.

DESCRIPTION OF EMBODIMENTS

Figure 1A:
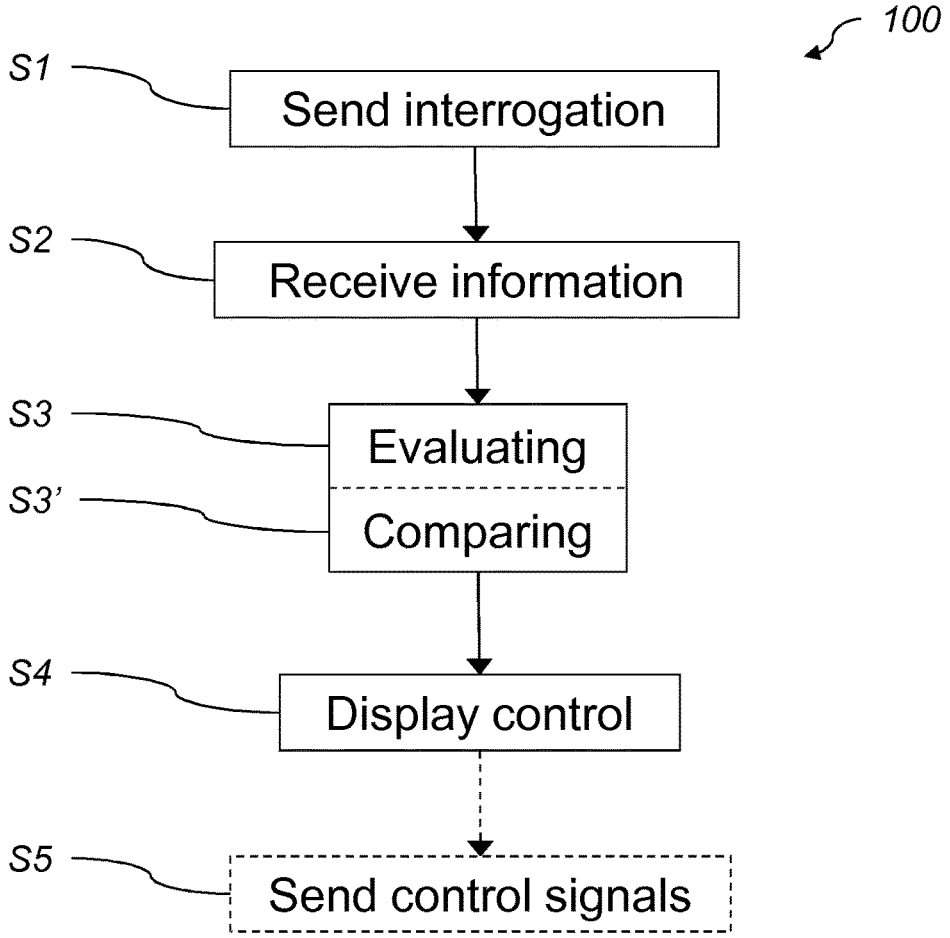
FIGS. 1*a* and 1*b* are flow charts illustrating methods according to embodiments of the present invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

Figure 2:
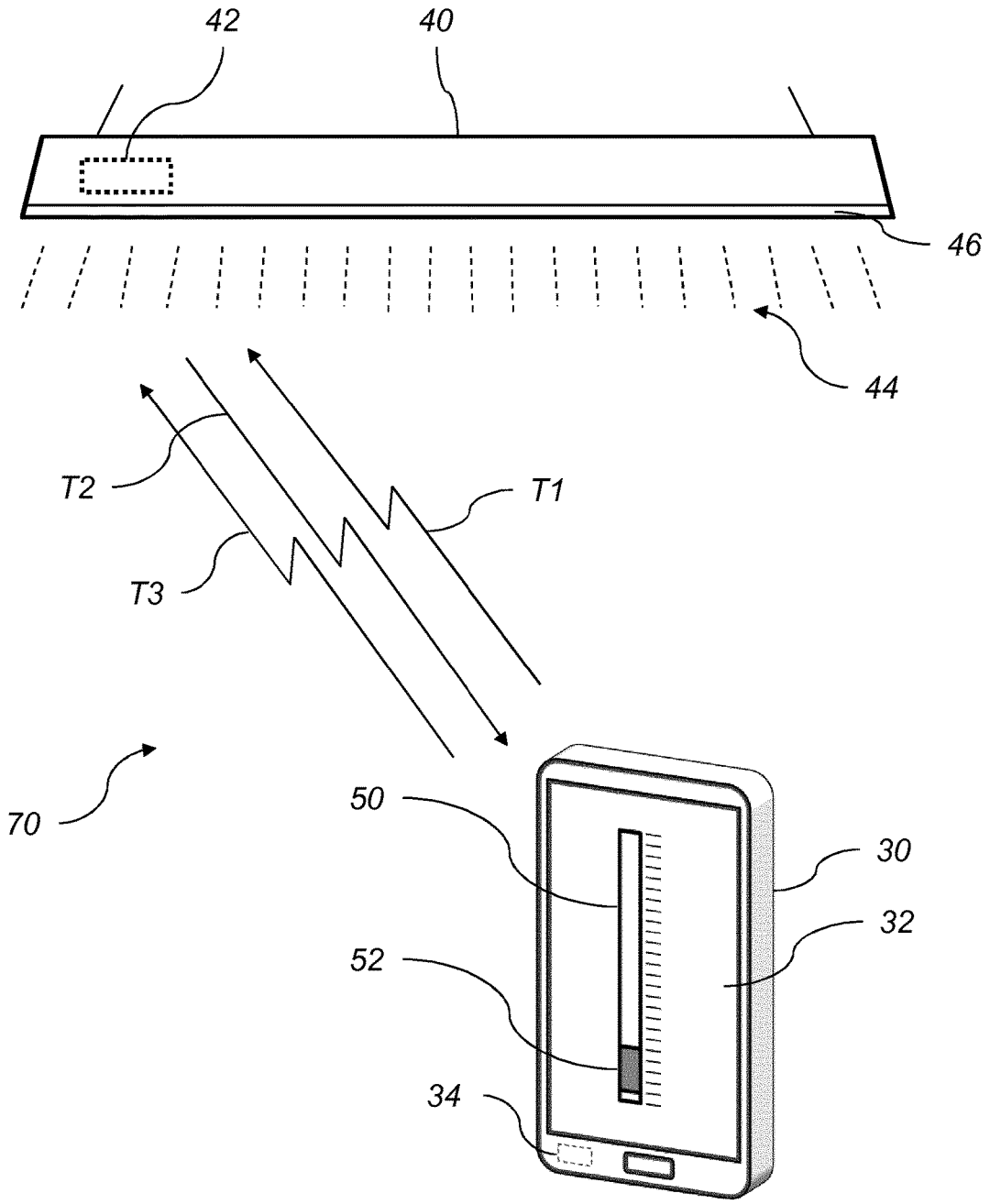
FIG. 2 is a schematic view of a system according to an embodiment of the present invention.

FIG. 1*a* illustrates together with FIG. 2 a method 100 and a system 70 for controlling light output 44 of a luminaire 40. The system 70 comprises the luminaire 40 and a control terminal 30. In a first step an interrogation T1 is sent S1 from the control terminal 30. The interrogation T1 requests information from the luminaire 40 regarding in which way the light output 44 of the luminaire 40 may be controlled when it comes to color and/or color temperature. The luminaire 40 comprises a control unit 42 which receives the interrogation T1 from the control terminal 30. The luminaire 40 further comprises at least one light source 46 for providing the light output 44.

Figure 1B:
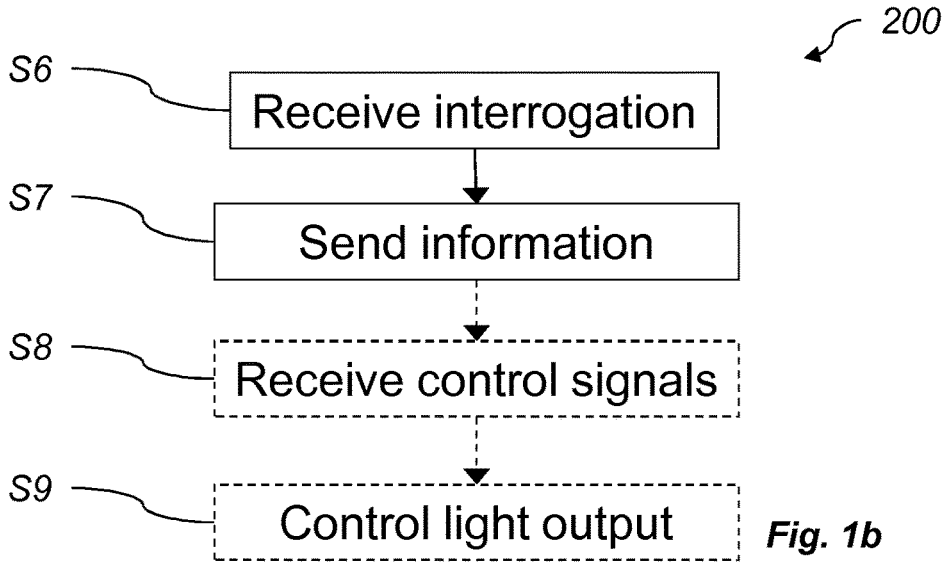

FIG. 1*b* illustrates a method 200 of operation of the control unit 42 in the luminaire. The control unit 42 receives S6 an interrogation T1 from a control terminal 30. As a response to the interrogation T1, the control unit 42 sends S7 the requested information T2 to the control terminal 30.

The control terminal 30 receives S2 the information T2 regarding light output 44 adjustment ability of the luminaire 40 from the control unit 42 as a response to the interrogation T1. The control terminal 30 evaluates S3 the received information T2 to determine how the light output 44 may be controlled, and what type of control should be used to enable a user to control the light output 44. The control terminal 30 comprises a terminal control unit 34 configured to perform the evaluation S3 of the received information T2. The terminal control unit 34 may comprise a processor. The terminal control unit 34 may further control the display 32.

Based on the result from the evaluation S3, is a selected control displayed S4 on a display 32 of the control terminal 30. The evaluation S3 determines whether the light output 44 should be controlled using a single-variable control 50 or a multi-variable control 60.

As seen in FIG. 2, a single-variable control 50 is displayed on the display 32 based on the received information T2 and the evaluation S3 thereof. When the selection and display of suitable control is made in the control terminal 30, a user may control the light output 44 of the luminaire 40 using the displayed control 50. The information T2 provided that a single-variable control 50 were to be used. The single-variable control 50 comprises a lever 52 for adjustment of a single parameter. Such parameter may be the color temperature of the light output 44. In the control 50 in FIG. 2 can the lever 52 be moved in a one-dimensional linear way to control the light output 44. When the single-variable control 50 is operated to control the light output 44, control signals T3 is sent S5 to the luminaire 40 and the control unit 42. When the control unit 42 receives S8 control signals T3, it controls S9 the light output 44 accordingly.

Figure 3:
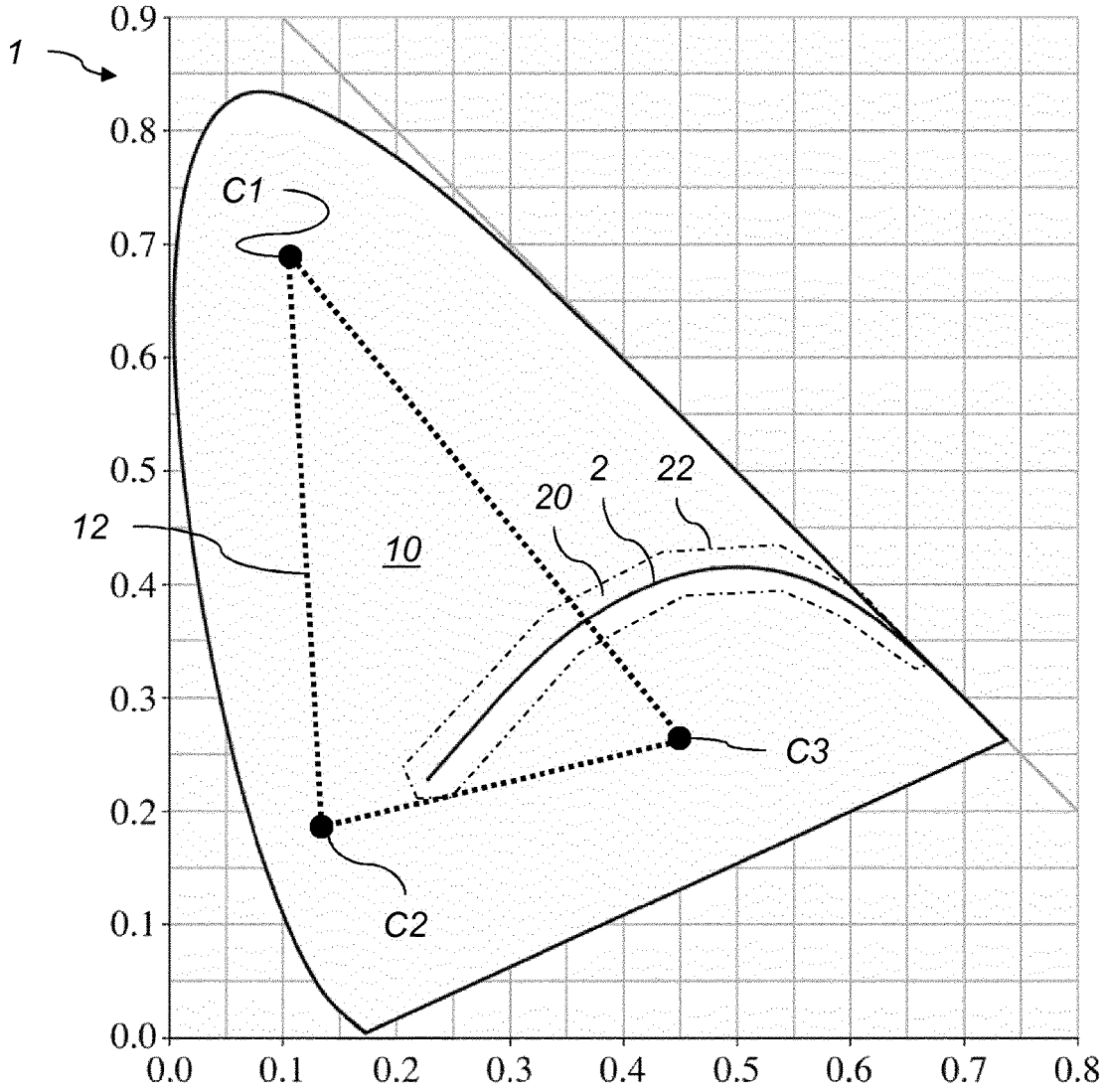
FIG. 3 shows a chromaticity diagram illustrating a method according to an embodiment of the present invention.

FIG. 3 illustrates a chromaticity diagram (CIE) 1 in which x- and y-coordinates may be selected for different colors or color temperatures. The information T2 provided by the control unit 42 in the luminaire 40 comprises three (or more) coordinates C1, C2, C3 in the chromaticity diagram 1. The coordinates C1, C2, C3 together defines an adjustment area 10, having a boundary 12. The adjustment area 10 provides limits for the colors or color temperatures to which the light output 44 of the luminaire 40 may be controlled. I.e. the colors or color temperatures within the adjustment area 10 may be selected when adjusting the light output 44.

The step of evaluating S3 the information T2 comprises in one embodiment a step of comparing S3' the adjustment area 10 with a predetermined area 20 in the chromaticity diagram 1. Information about the predetermined area 20 may be stored in the control terminal 30. The predetermined area 20 has a boundary 22. The predetermined area 20 is in the illustrated embodiment focused around the black body locus 2 in the chromaticity diagram 1.

The adjustment area 10 is compared S3' to the predetermined area 20 to determine if the adjustment area 10 extends outside the predetermined area 20. This may be done by analyzing the positions of the coordinates C1, C2, C3 and determine whether any of the coordinates C1, C2, C3 is located outside the predetermined area 20.

In FIG. 3, the adjustment area 10 extends outside the predetermined area 20, providing that the comparison S3' results in a first condition. In such first condition, the light output 44 is controllable to colors or color temperatures within the two-dimensional adjustment area 10 in the chromaticity diagram 1. Following this, a multi-variable control 60 is displayed on the control terminal 30 to enable a user to control the color parameters of the light output 44.

Figure 4:
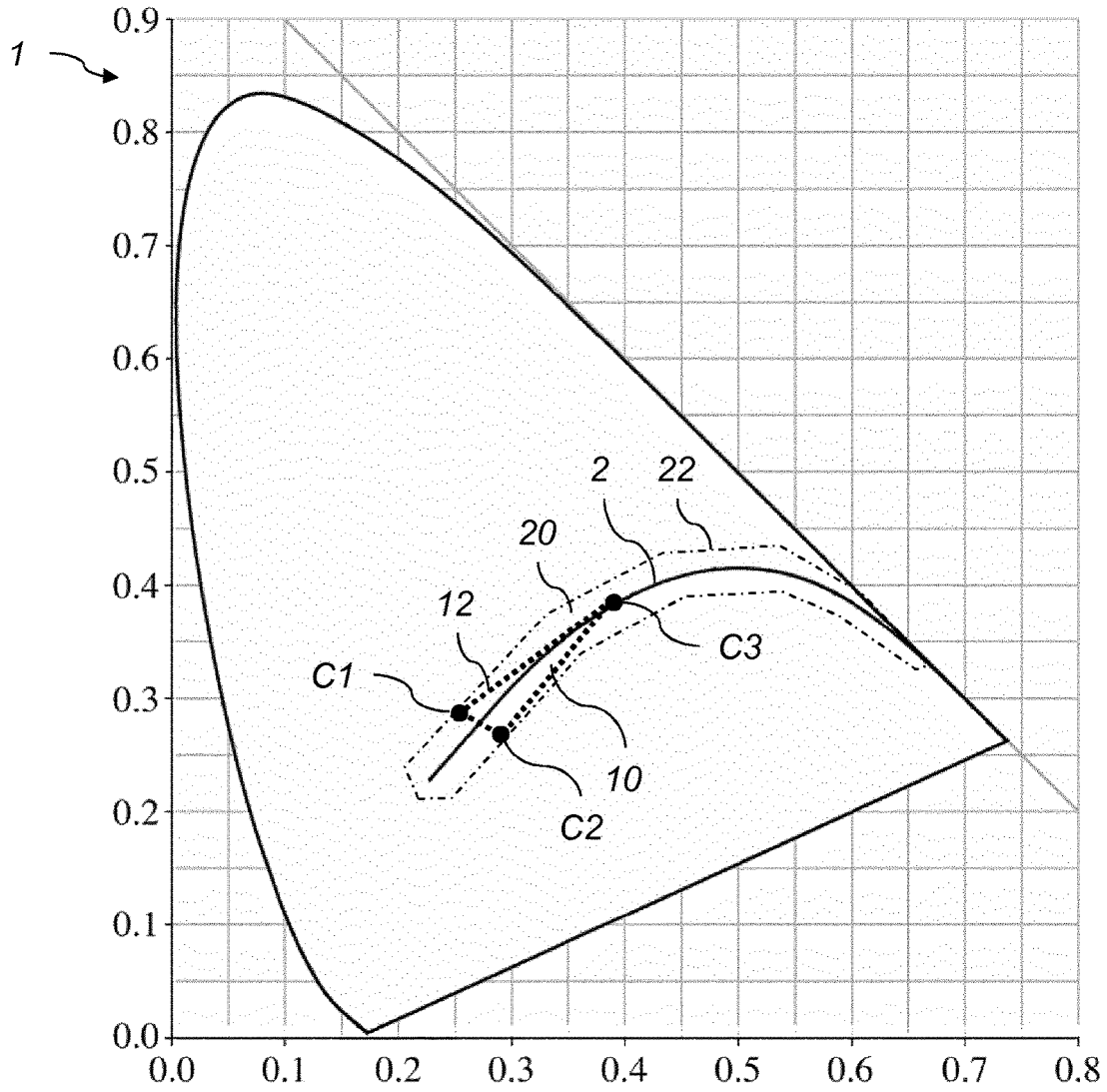
FIG. 4 shows a chromaticity diagram illustrating a method according to an embodiment of the present invention.

In FIG. 4 is a situation illustrated wherein the coordinates C1, C2, C3 all are located within the predetermined area 20. The comparison S3' thereby results in a second condition. In the embodiment wherein the predetermined area 20 is focused around the black body locus 2, the second condition may provide that the color temperature of the light output 44 is adjustable along the black body locus 2. Following this, a single-variable control 50 is displayed on the control terminal 30 to enable a user to control the color temperature parameter of the light output 44. The single-variable control 50 provides adjustment of the light output 44 along the entire or part of the black body locus 2. Adjustment may be enabled along a part of the black body locus, which part falls within the adjustment area 10.

Figure 5:
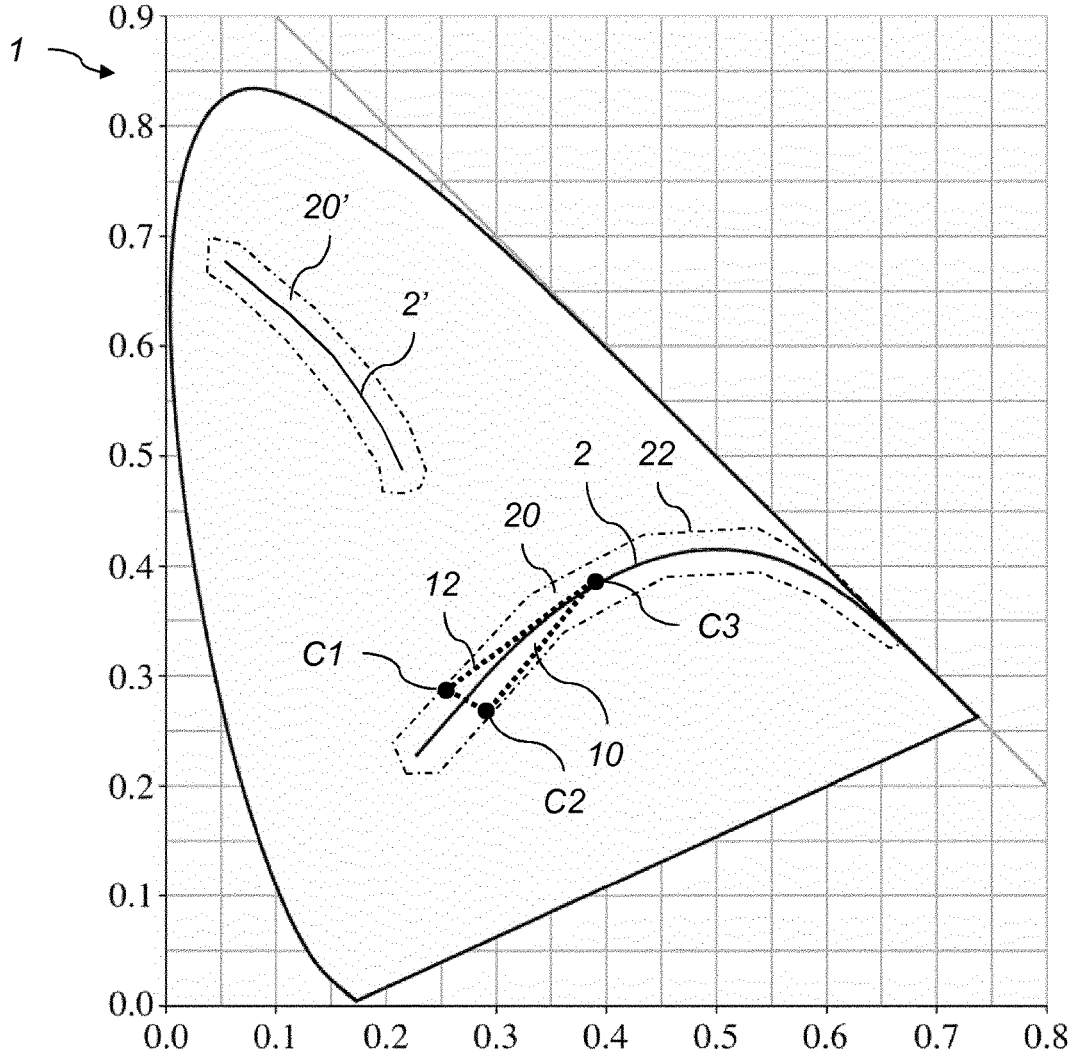
FIG. 5 shows a chromaticity diagram illustrating a method according to an embodiment of the present invention.

In one embodiment, illustrated in FIG. 5, the adjustment area 10 is compared to two (or more) separate predetermined areas 20, 20'. If the coordinates of the adjustment area 10 all is located within any, but the same, of the predetermined areas 20, 20', said second condition is fulfilled and a single-variable control is selected and displayed for control of the light output 44. If the adjustment area 10 falls within a second predetermined area 20', the light output 44 may be controllable by means of a single-variable control 50 along an imaginary line 2' within the second predetermined area 20'.

Figure 6:
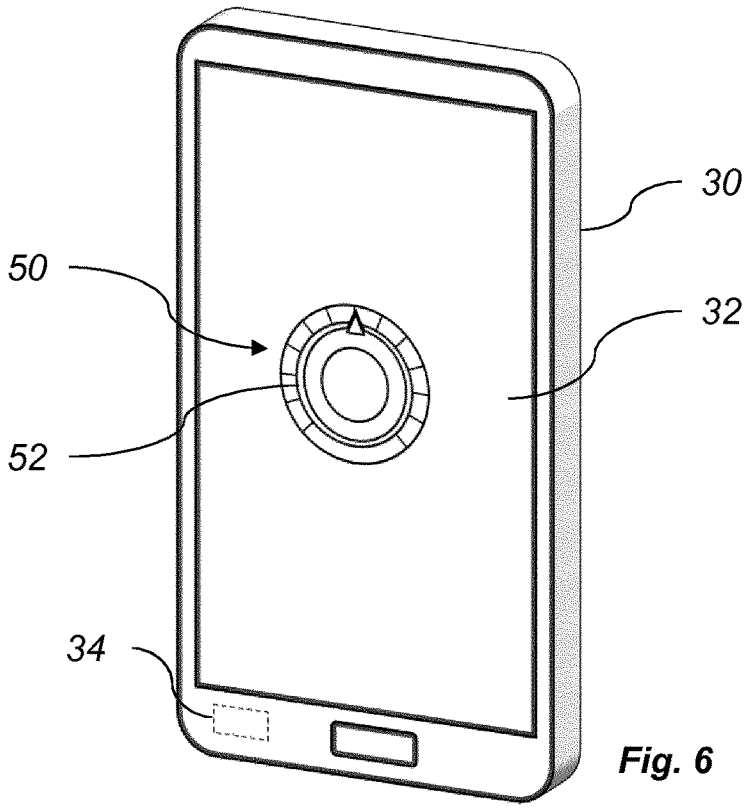
FIG. 6 is a perspective view of a control terminal according to an embodiment of the present invention.

FIG. 6 illustrates a control terminal 30 on which a knob-like single-variable control 50 is displayed. Such knob-like control 50 may be displayed as an alternative to the linear control 50 illustrated in FIG. 2. The knob-like control 50 comprises a turning knob 52 which may be rotated by a user to control a single light output parameter of the light output 44.

Figure 7:
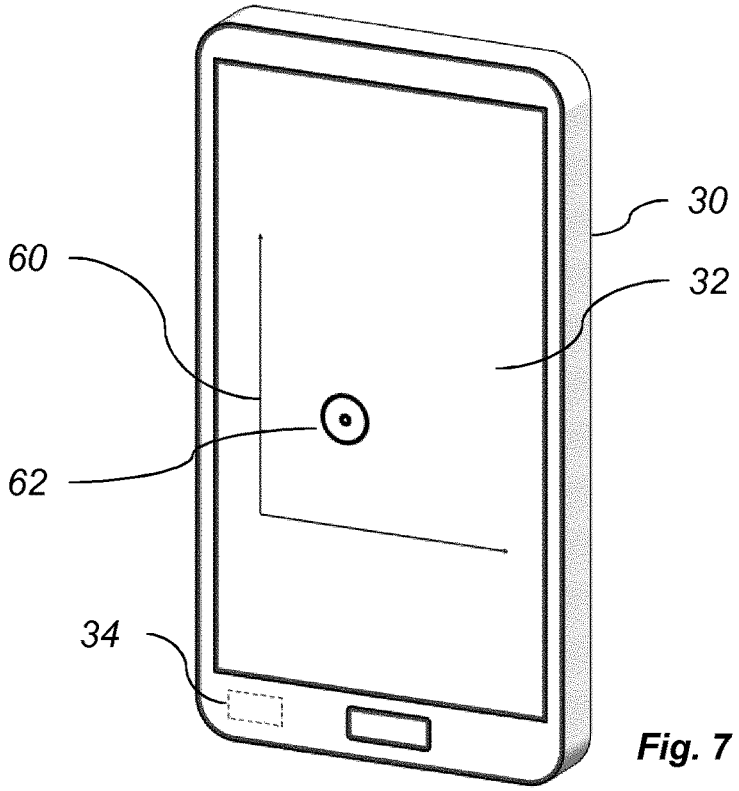
FIG. 7 is a perspective view of a control terminal according to an embodiment of the present invention.
Figure 8:
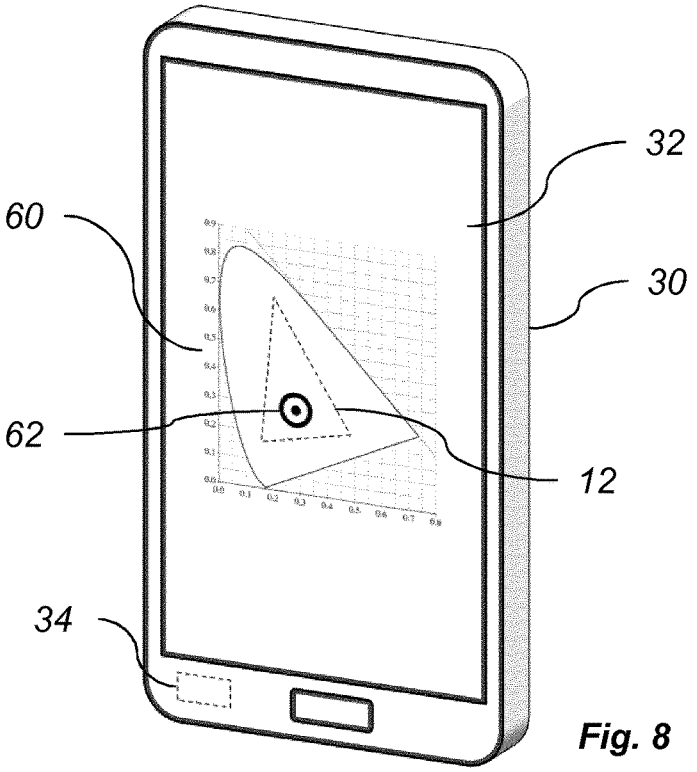
FIG. 8 is a perspective view of a control terminal according to an embodiment of the present invention.
Figure 9:
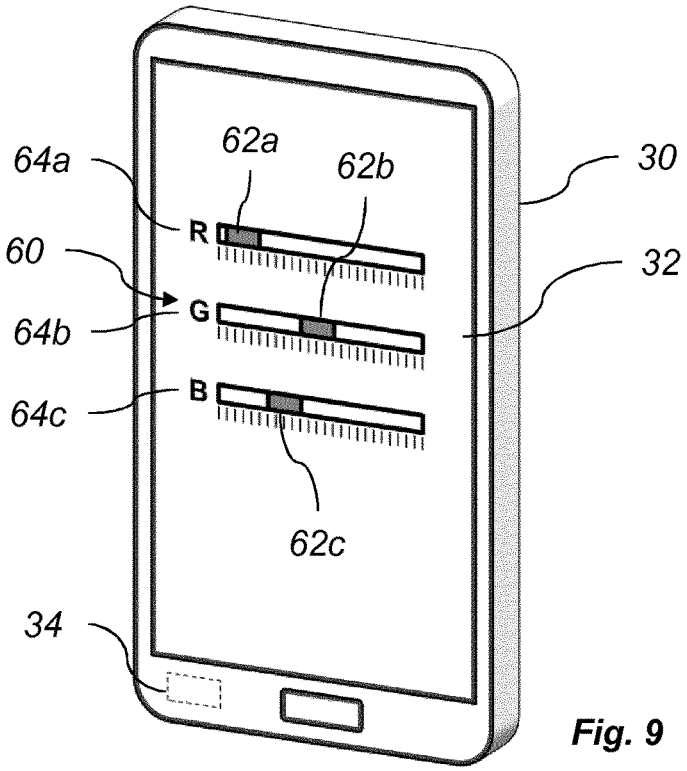
FIG. 9 is a perspective view of a control terminal according to an embodiment of the present invention.

FIGS. 7-9 illustrate control terminals 30 on which different alternatives of multi-variable controls 60 are displayed. In FIG. 7 is the multi-variable control 60 provided as a two-dimensional diagram in which a selection point 62 may be moved by a user to control two light output parameters of the light output 44. The two light output parameters is represented by the x and y axis respectively.

In FIG. 8 is the multi-variable control 60 provided as a chromaticity diagram in which a selection point 62 indicates a selected parameter selection. The two light output parameters controllable in the control 60 are represented as x- and y-coordinates in the chromaticity diagram of the multi-variable control 60. The multi-variable control 60 may further show the boundaries 12 of the adjustment area 10 to provide limits for the movement of the selection point 62 in the diagram.

In FIG. 9 is the multi-variable control 60 provided as a control comprising three separately controllable parameter controls 64. In the illustrated embodiment the multi-variable control 60 comprises separate red, green and blue controls for an RGB color control. Each parameter control 64*a*, 64*b*, 64*c* comprises a lever 62*a*, 62*b*, 62*c* that is adjustable along a linear path. Alternatively, each parameter control 64*a*, 64*b*, 64*c* could comprise a knob-like control as illustrated in FIG. 5.

The display of single- or multi-variable controls described herein is referred to as display of a graphical user interface comprising such control, and wherein the control terminal 30 comprises an interface, such as a touch display or buttons, for a user to operate the displayed control.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A method (100) of controlling light output (44) of a luminaire (40) using a control terminal (30), the luminaire comprising at least one light source (46) and a control unit (42), the control terminal comprising a display (32), the method comprising the steps of:

sending (S1), from the control terminal to the control unit, an interrogation (T1) of light output adjustment properties of the luminaire, receiving (S2), from the control unit to the control terminal, information (T2) of light output adjustment properties of the luminaire, said information (T2) comprising at least three input values representing coordinates (C1, C2, C3) in a chromaticity diagram (1) defining an adjustment area (10), evaluating (S3) the information of light output adjustment properties from the luminaire by evaluating the adjustment area in the chromaticity diagram, and displaying (S4), on the display of the control terminal, a light output control (50, 60), for adjustment of the color or color temperature of the luminaire, the light output control being single-variable (50) or multi-variable (60) depending on the evaluation (S3) of the information (T2) of light output adjustment properties received from the control unit (42).

2. The method according to claim 1, wherein the step of evaluating (S3) the information (T2) comprises a step of comparing (S3') the adjustment area (10) in the chromaticity diagram (1) with a predetermined area (20) in the chromaticity diagram.

3. The method according to claim 2, wherein the step of comparing (S3') the adjustment area (10) with the predetermined area (20) comprises a step of determining if the adjustment area extends outside the predetermined area.

4. The method according to claim 3, wherein the step of displaying (S4) a light output control (50, 60) on the display (32) of the control terminal (30) comprises a step of displaying a multi-variable control (60) if the adjustment area (10) is determined to extend outside the predetermined area (20), and a step of displaying a single-variable control (50) if the adjustment area is determined to be within the predetermined area.

5. The method according to claim 2, wherein the predetermined area (20) is focused around the black body locus (2).

6. The method according to claim 1, wherein the control unit (42) comprises a DALI driver configured to receive the interrogation (T1) from the control terminal (30) and to provide the information (T2) of light output adjustment properties sent to the control terminal.

7. A computer program product characterized in that the computer program product is configured to, when executed in a control terminal (30) comprising a display (32), perform the method (100) according to claim 1.

8. A control terminal (30) comprising a display (32) and the computer program product according to claim 7.

9. The control terminal according to claim 8, wherein the control terminal (30) is a mobile device.

10. A luminaire (40) comprising at least one light source (46) and a control unit (42), wherein the control unit is configured to receive (S5), from a control terminal (30), an interrogation (T1) of light output adjustment properties of the luminaire, and send (S6), as a response to the interrogation, information (T2) to the control terminal of the light output adjustment properties of the luminaire, wherein the information of light output adjustment properties is provided as at least three input values representing coordinates in a chromaticity diagram (1) defining an adjustment area (10) within which the light output (46) of the luminaire is adjustable.

11. The luminaire according to claim 10, wherein the control unit (42) comprises a DALI driver.

12. A luminaire system comprising a control terminal (30) according to claim 8, and a luminaire (40) comprising at least one light source (46) and a control unit (42), wherein the control unit is configured to receive (S5), from a control terminal (30), an interrogation (T1) of light output adjustment properties of the luminaire, and send (S6), as a response to the interrogation, information (T2) to the control terminal of the light output adjustment properties of the luminaire, wherein the information of light output adjustment properties is provided as at least three input values representing coordinates in a chromaticity diagram (1) defining an adjustment area (10) within which the light output (46) of the luminaire is adjustable.

13. The luminaire system according to claim 12, wherein the control unit (42) comprises a DALI driver.

14. A luminaire system comprising a control terminal (30) according to claim 9, and a luminaire (40) comprising at least one light source (46) and a control unit (42), wherein the control unit is configured to receive (S5), from a control terminal (30), an interrogation (T1) of light output adjustment properties of the luminaire, and send (S6), as a response to the interrogation, information (T2) to the control terminal of the light output adjustment properties of the luminaire, wherein the information of light output adjustment properties is provided as at least three input values representing coordinates in a chromaticity diagram (1) defining an adjustment area (10) within which the light output (46) of the luminaire is adjustable.

15. The luminaire system according to claim 14, wherein the control unit (42) comprises a DALI driver.

16. The control terminal according to claim 9, wherein the mobile device is selected from the group consisting of a mobile phone, a smart phone, and a tablet computer.

* * * * *